US008670697B2

(12) United States Patent
Pohlt

(10) Patent No.: US 8,670,697 B2
(45) Date of Patent: Mar. 11, 2014

(54) METHOD TO OPTIMIZE THE TRANSFER OF DEVELOPER FLUID ONTO A PRINTING SUBSTRATE IN AN ELECTROPHORETIC PRINTING APPARATUS

(75) Inventor: Michael Pohlt, Munich (DE)

(73) Assignee: Océ Printing Systems GmbH, Poing (DE)

( * ) Notice: Subject to any disclaimer, the term of this patent is extended or adjusted under 35 U.S.C. 154(b) by 149 days.

(21) Appl. No.: 13/180,859

(22) Filed: Jul. 12, 2011

(65) Prior Publication Data

US 2012/0008990 A1 Jan. 12, 2012

(30) Foreign Application Priority Data

Jul. 12, 2010 (DE) ..... 10 2010 036 335

(51) Int. Cl.
*G03G 15/16* (2006.01)

(52) U.S. Cl.
USPC ..... 399/269; 399/254

(58) Field of Classification Search
USPC ..... 399/259, 296
See application file for complete search history.

(56) References Cited

U.S. PATENT DOCUMENTS

| | | | | |
|---|---|---|---|---|
| 4,746,646 | A * | 5/1988 | Nakanishi et al. | 503/227 |
| 5,555,185 | A | 9/1996 | Landa | |
| 6,020,103 | A * | 2/2000 | Tsubuko et al. | 430/118.8 |
| 7,079,798 | B2 * | 7/2006 | Suzuki et al. | 399/302 |
| 7,460,823 | B2 * | 12/2008 | Asakura et al. | 399/340 |
| 2002/0110390 | A1 * | 8/2002 | Park et al. | 399/237 |
| 2006/0150836 | A1 | 7/2006 | Berg et al. | |
| 2007/0147862 | A1 * | 6/2007 | Nakamura et al. | 399/45 |
| 2008/0131807 | A1 * | 6/2008 | Teshima et al. | 430/115 |
| 2008/0220362 | A1 | 9/2008 | Moore et al. | |
| 2008/0279597 | A1 * | 11/2008 | Berg et al. | 399/279 |

FOREIGN PATENT DOCUMENTS

| | | | | |
|---|---|---|---|---|
| EP | 2187268 | | 5/2010 | |
| JP | 06-332235 | A * | 12/1994 | G03G 9/08 |
| WO | 2005/013013 | | 2/2005 | |

OTHER PUBLICATIONS

Ed Felton, Fingerprinting Blank Paper Using Commodity Scanners, Mar. 13, 2009, Freedom to Tinker, https://freedom-to-tinker.com/blog/felten/fingerprinting-blank-paper-using-commodity-scanners/. *

* cited by examiner

*Primary Examiner* — Clayton E Laballe
*Assistant Examiner* — Jas Sanghera
(74) *Attorney, Agent, or Firm* — Schiff Hardin LLP

(57) ABSTRACT

In a method to optimize transfer of a developer fluid on a printing substrate in an electrophoretic printing apparatus, a developer fluid containing at least carrier fluid and toner particles is used, the toner particles having sizes that are greater than diameters of capillaries in a surface of the printing substrate. The additive particles are added to the developer fluid before the transfer, sizes of the additive particles being selected such that the sizes are smaller at least in part in comparison to the diameters of the capillaries in the surface of the printing substrate.

7 Claims, 4 Drawing Sheets

METHOD TO OPTIMIZE THE TRANSFER OF DEVELOPER FLUID ONTO A PRINTING SUBSTRATE IN AN ELECTROPHORETIC PRINTING APPARATUS

BACKGROUND

To print a printing substrate—for example a single sheet or a belt-shaped recording material made of the most varied materials, for example paper or thin plastic or metal films—it is known to generate image-dependent charge images on a charge image carrier (for example a photoconductor), which charge images correspond to the images to be printed, comprised of regions to be inked and regions that are not to be inked. The regions of the charge images that are to be inked are made visible as toner images on the charge image carrier via toner particles with a developer station. The toner image that is thereby generated is subsequently transfer-printed onto the printing substrate in a transfer printing zone and is fixed there.

A developer fluid having at least charged toner particles and carrier fluid can thereby be used to ink the charge images. Possible carrier fluids are hydrocarbons or silicone oil, among others.

A method for such an electrophoretic printing in digital printing systems is known from WO 2005/013013 A2 (US 2006/0150836 A1, DE 10 2005 055 156 B3), for example. After the charge images of the images to be printed have been generated on the charge image carrier, these are inked with toner particles by a developer station to form toner images. Here a carrier fluid containing silicone oil with dye particles (toner particles) dispersed in it is thereby used as a developer fluid. The supply of developer fluid to the charge image carrier can take place via a developer roller that supplies the developer fluid via an inking roller. The toner images are subsequently embedded in carrier fluid, accepted by a transfer unit from the charge image carrier, and transferred onto the printing substrate in a transfer printing zone.

In this printing method using developer fluid, the process of electrophoresis is thus used to transfer toner particles in the carrier fluid to the printing substrate, for example via a transfer roller arranged in the transfer unit. The solid, electrically-charged toner particles thereby migrate to the printing substrate via the carrier fluid as a transport medium, wherein the transport can be controlled via an electrical field between the transfer roller and the printing substrate. The layer separates from the carrier fluid after the contact region (nip) between the transfer roller and printing substrate in the depleted region, such that the toner particles are deposited on the printing substrate with high efficiency. In addition to the toner particle charge and the electrical field, a requirement for this is the provision of a sufficiently thick carrier fluid layer through which the toner particles can migrate.

In the transfer of the toner image it is a goal to deliver the toner particles onto the printing substrate together with optimally little carrier fluid. The transfer process should thereby function given the most different types of printing substrates. The printing substrates can differ in a number of properties. For example, coated papers that have a smooth surface are used as printing substrates since a coating color is applied on their surface. The coating color contains pigments that can have different size and shape. With the aid of the size and shape of the pigments, the system of the capillaries or the system of the pores (designated only as capillaries in the following) can be adjusted so that the capillaries correspond to the requirements of the application. Via selection of the size distribution of the pigments it is achieved that size distributions of the capillaries are varied in wide ranges.

However, problems occur in the transfer printing of the toner image onto the printing substrate in the transfer printing zone. The transfer of the toner image to the printing substrate is affected by the capillaries and by roughness in the printing substrate surface (paper, for example). Namely, the capillaries in the printing substrate suck carrier fluid from its surface into the printing substrate, with the result that the adhesion of the toner images to the printing substrate is reduced. For the transfer of the toner images onto the printing substrate it is advantageous if optimally all carrier fluid is kept on the surface of the printing substrate. For this the carrier fluid optimally may not be drawn into the capillaries in the printing substrate. The carrier fluid is required on the surface, namely for the electrophoresis process.

One method to reduce this problem is the transfuse method corresponding to U.S. Pat. No. 5,555,185. The carrier fluid is thereby no longer used as a transport medium in the transfer-printing of the toner images to the printing substrate. Instead of this, the toner particles are softened in the transfer unit via the application of high temperatures and then adapted with pressure to the printing substrate. A large, common surface thereby arises between printing substrate and toner image with large adhesion forces. The toner particles are transferred from the transfer roller onto the printing substrate in the transfer unit via these surface forces, although the carrier fluid is not used as a transport medium.

SUMMARY

It is an object to specify a method to transfer developer fluid to the printing substrate in a digital electrophoretic printing apparatus, in which method the penetration of the carrier fluid into the printing substrate is minimal.

In a method to optimize transfer of a developer fluid on a printing substrate in an electrophoretic printing apparatus, a developer fluid containing at least carrier fluid and toner particles is used, the toner particles having sizes that are greater than diameters of capillaries in a surface of the printing substrate. The additive particles are added to the developer fluid before the transfer, sizes of the additive particles being selected such that the sizes are smaller at least in part in comparison to the diameters of the capillaries in the surface of the printing substrate.

DESCRIPTION OF THE PREFERRED EMBODIMENT

Figure 1:
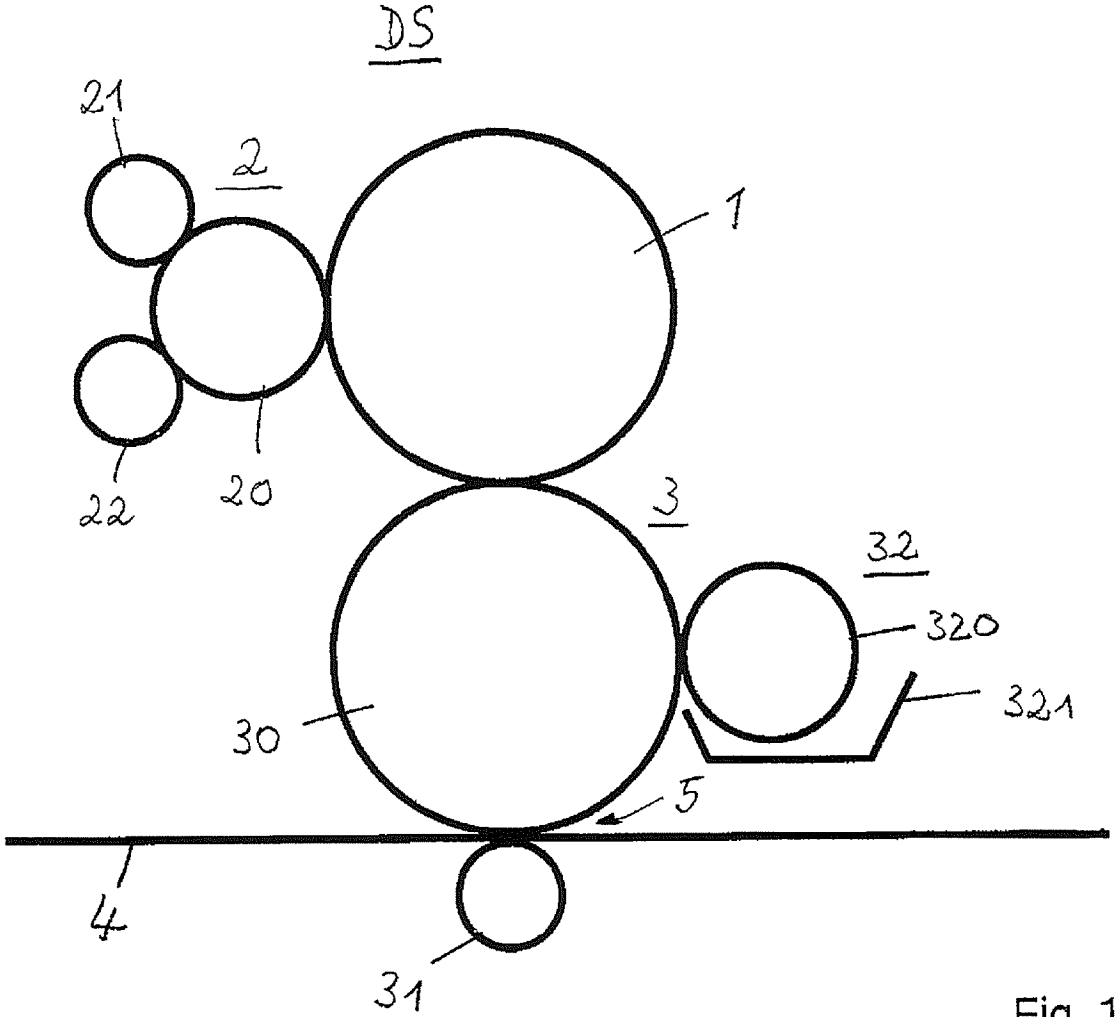
FIG. 1 is a principle depiction of an electrophoretic printing apparatus.

For the purposes of promoting an understanding of the principles of the invention, reference will now be made to the preferred embodiment/best mode illustrated in the drawings and specific language will be used to describe the same. It will nevertheless be understood that no limitation of the scope of the invention is thereby intended, and such alterations and further modifications in the illustrated embodiment and such further applications of the principles of the invention as illustrated as would normally occur to one skilled in the art to which the invention relates are included.

In the method according to the preferred embodiment to transfer a developer fluid in an electrophoretic printing apparatus, given the transfer-printing of the toner images to the printing substrate the composition of the developer fluid is adjusted so that the carrier fluid is drawn into the printing substrate only to a small extent, and therefore the transfer of the toner images onto the printing substrate can take place in sufficient carrier fluid. For this purpose additive particles are added to the developer fluid, a size distribution of which additive particles is selected such that sizes of the additive particles are smaller at least in part in comparison to sizes of the capillaries in a surface of the printing substrate. Given a minimal capillary width of 0.2 μm, for example, these additive particles can have a size distribution of up to less than 0.2 μm.

Toner particles of corresponding size (for example in a size of up to 0.2 μm) can be used as additive particles. Or, transparent additive particles whose size distribution is in a range from 0.1 to 0.5 μm can be added to the developer fluid in the transfer unit.

The printing apparatus according to the preferred embodiment therefore has the following advantages:

- an improvement of the transfer from toner images to graphic art papers at room temperature is achieved, connected with a longer service life of the rollers (such as transfer roller, cleaning roller) used in the transfer;
- the efficiency of the transfer is increased;
- carrier fluid is saved since the carrier fluid remains on the surface of the printing substrate and can be used more efficiently;
- the fixing of the toner images is facilitated.

FIG. 1 shows the components of a printing system DS as it is known from WO 2005/013013 A2 (DE 10 2005 055 156 B3), for example. DE 10 2005 055 156 B3 is herewith incorporated into this disclosure. In addition to a regeneration exposure, a charging station, a character generator (these components are not shown; refer in this regard to DE 10 2005 055 156 B3), a developer station 2 to develop the charge images on the charge image carrier 1 and a transfer unit 3 for transfer-printing of the developed charge images onto a printing substrate 4 are arranged along a rotating charge image carrier 1 (a photoconductor drum in FIG. 1). The developer station 2 has a rotating developer roller 20 which is arranged in contact with the charge image carrier 1. Charge images arranged on the charge image carrier 1 are developed into toner images with the developer roller 20. For this a developer fluid made up of at least a carrier fluid and electrically charged toner particles is used that is supplied to the developer roller 20 via an inking roller 21. The developer fluid remaining on the developer roller 20 after the development of the charge images is cleaned off by a cleaning roller 22. The transfer unit 3 has, in a known manner, a transfer roller 30 and a counter-pressure roller 31 between which the printing substrate 4 is directed. A conditioning unit 32 with a roller 320 and a trough 321 can additionally be provided in order to affect the developer fluid on the transfer roller 30.

In the transport of the developer fluid from the developer roller 20 to the printing substrate 4, the toner particles migrate in the carrier fluid up to the transfer printing zone 5; and in the transfer printing zone 5 the toner images then migrate in the carrier fluid to the printing substrate 4.

One problem is thereby especially the transfer-printing of the toner images onto the printing substrate 4, since difficulties occur here due to the capillaries in the printing substrate 4, for example. These problems are explained using FIG. 2 and FIG. 4.

Figure 2:
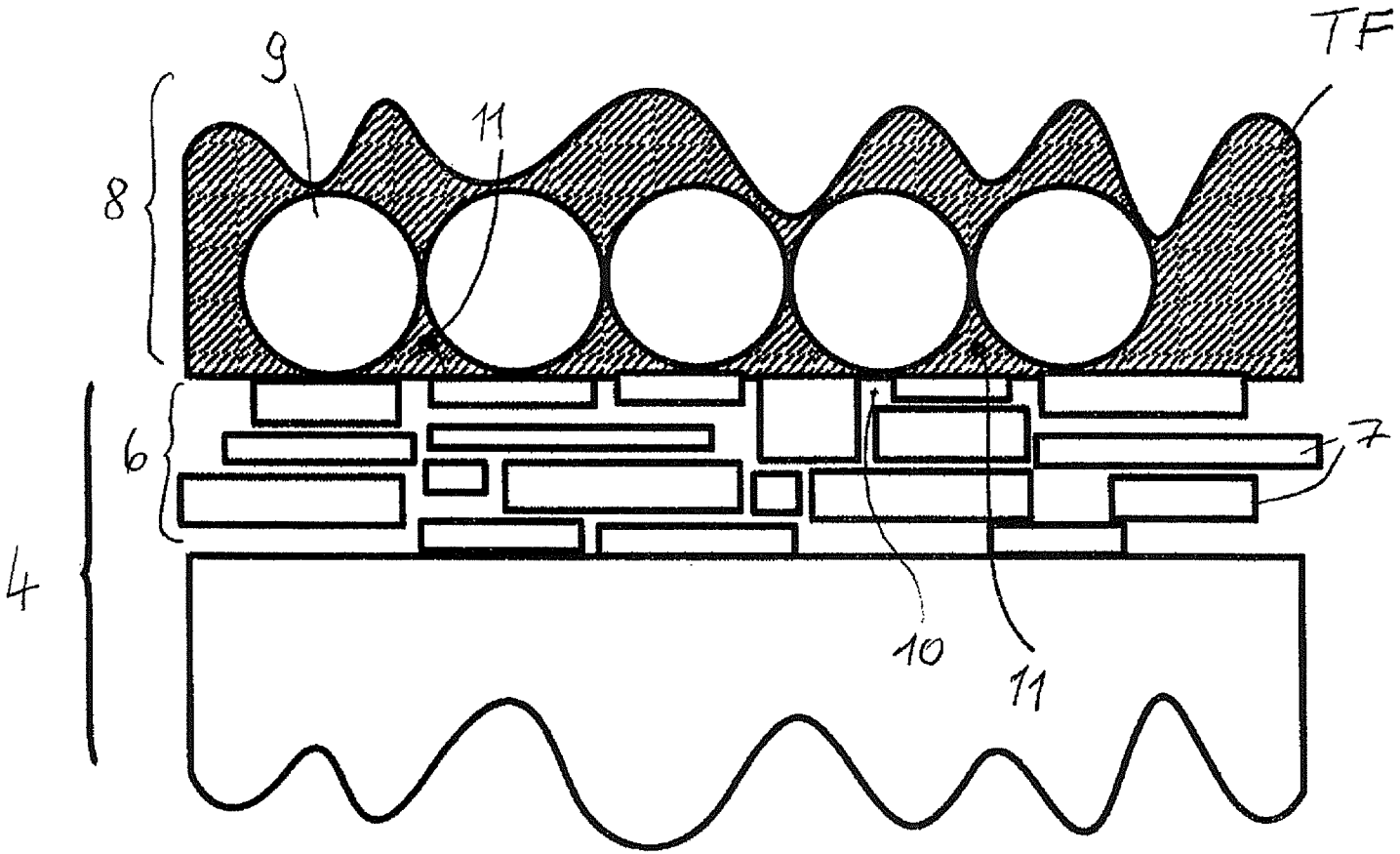
FIG. 2 is a principle depiction of the transfer relationships to the printing substrate without use of the preferred embodiment.

FIG. 2 shows in principle a layer 6 of fibers in the printing substrate 4 or, given a coated printing substrate 4, a layer 6 made up of the coating color that, among other components, contains pigments 7 (in the following explanation a coated printing substrate 4—paper, for example—is assumed, meaning that a layer 6 of coating with pigments 7 is applied to the paper 4; however, the preferred embodiment is not limited to this). A layer 8 of developer fluid in which toner particles 9 are embedded in a carrier fluid TF is arranged on the layer 6 made of color coating. The toner particles 9 are selected to be larger in comparison to the capillaries 10 between pigments, in which capillaries gas is located. Capillaries 11 in which carrier fluid TF is arranged likewise exist between the toner particles 9.

Figure 4:
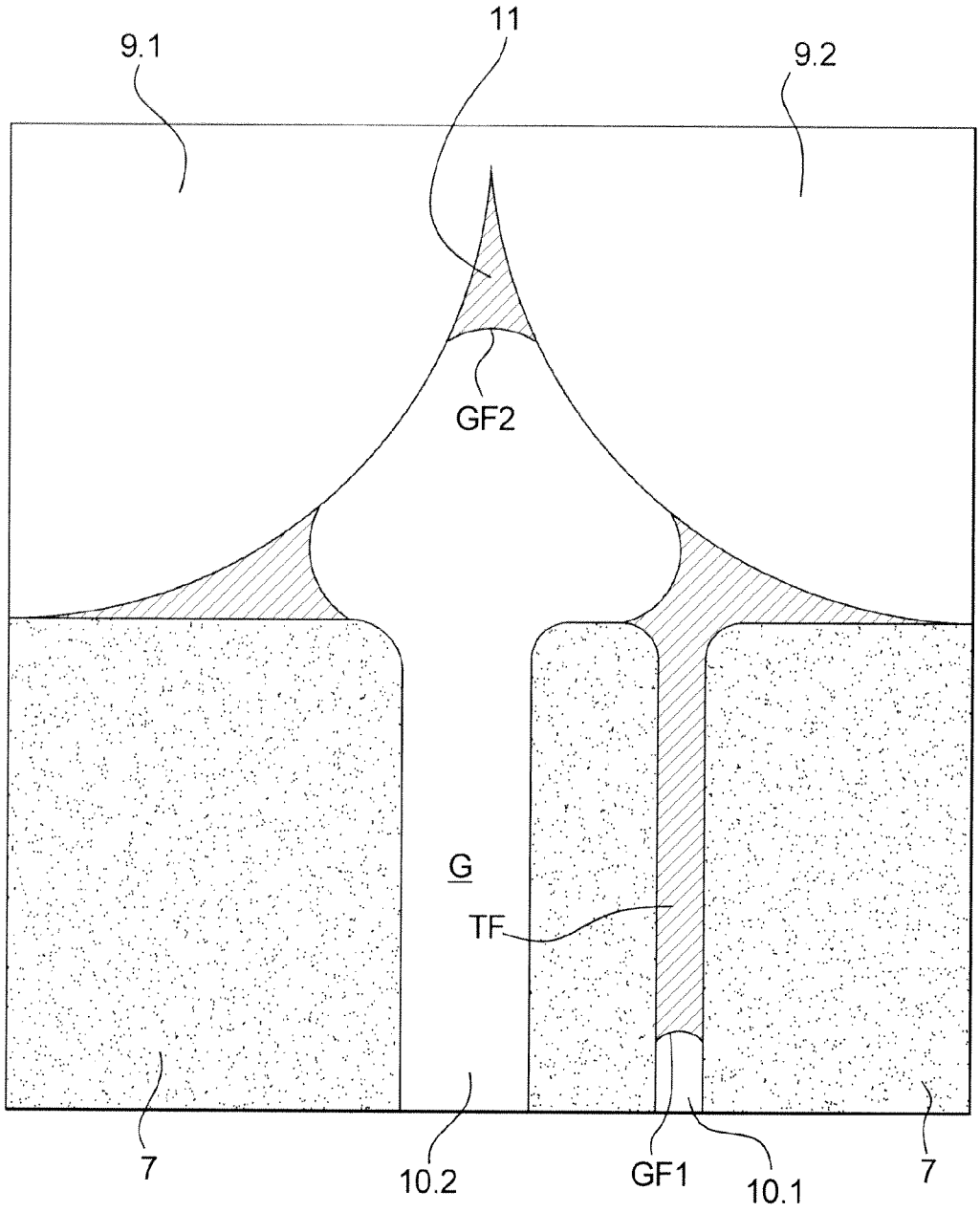
FIG. 4 is a principle depiction of the capillary relationships to the border region between the printing substrate and the developer fluid.

The process of the penetration or absorption of carrier fluid TF into the printing substrate 4 is explained using FIG. 4. FIG. 4 shows in section the border region between the layer 8 made of developer fluid and the pigment layer 6 of the printing substrate 4. Two capillaries 10.1 and 10.2 of different diameter are shown in the pigment layer 6, and a capillary 11 is additionally shown between two toner particles 9.1 and 9.2 in the carrier fluid TF. The capillaries 10.1 thereby have a smaller diameter in comparison to the capillaries 10.2. Furthermore, the intervening space between the toner particles 9.1 and 9.2 can be viewed as a capillary 11. Pressure differences Δp that depend on the curvature radius r of the interface GF between the gas G and the carrier fluid TF in the capillaries form at the interfaces GF between gas G and carrier fluid TF. For the pressure difference Δp it applies that:

$$\Delta p = 2s/r \tag{1}$$

wherein s=surface tension and r is the curvature radius at the respective interface GF between the gas G and the carrier fluid TF.

With regard to FIG. 4, it then applies that:

the smaller the curvature radius r1 of the interface GF1 in the capillary 10, the more carrier fluid TF migrates from the toner particle-carrier fluid mixture 8 on the surface of the printing substrate 4 into the printing substrate 4, with the consequence that the exchange gas G must escape from a capillary 10 to the surface of the printing substrate 4 in the carrier fluid RF. For example, if the capillary 10.1 has a smaller diameter, according to Formula (1) carrier fluid TF accordingly migrates into the capillary 10.1. In the example of FIG. 4, for example, the displaced gas G migrates into the capillary 10.2 (which has a larger diameter) and displaces the carrier fluid TF in the direction of the capillary 11. A fluid-gas interface GF2 that has a curvature r2 re-forms there. Here the correlation $$\Delta p = 2s/r$$

also applies. Equilibrium arises when the curvature radius in the capillary 11 is equal to the curvature radius on the surface of the printing substrate 4.

This means that capillaries with smaller diameter can pump down more carrier fluid from the toner particle-carrier fluid mixture into the printing substrate 4 than capillaries with larger diameter.

In order to avoid these problems, additive particles 12 or additives are added to the developer fluid (corresponding to FIG. 3), and the size distribution of the particles 9, 12 in the layer 8 made of developer fluid on the printing substrate 4 is changed.

Figure 3:
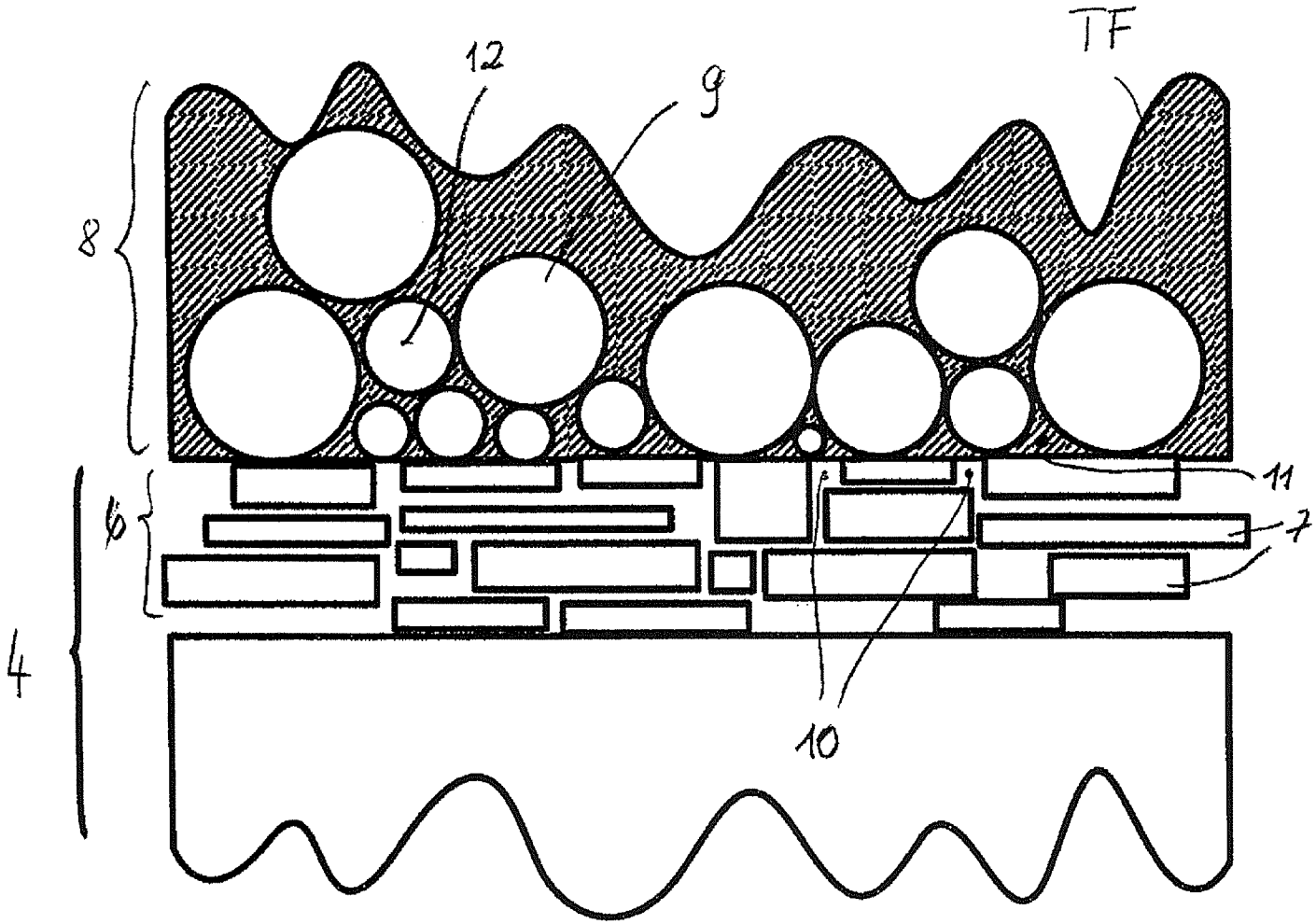
FIG. 3 is a principle depiction of the transfer relationships to the printing substrate given use of the preferred embodiment.

In a first exemplary embodiment, toner particles 9 can be used as additive particles 12 and for this the size distribution of the toner particles 9 can be changed. Namely, if the capillaries 11 between the toner particles and additive particles 9 in the developer fluid layer 8 are of smaller diameter than the capillaries 10 in the printing substrate 4, the equilibrium of the pressures Δp has already appeared at the interface GF between printing substrate 4 and developer fluid before carrier fluid TF penetrates into the printing substrate 4 to a critical extent. The toner particles 9 can then keep the carrier fluid TF on the surface of the printing substrate 4. For this the size distribution of the toner particles 9 is adapted to the typical size distributions of the pigments 7 in the printing substrate 4. If the diameter of the capillaries 10 in the printing substrate 4 is 0.2 μm, for example, the size distribution in the toner particles 9 should extend below 0.2 μm. The surface of the printing substrate 4 can then no longer draw carrier fluid TF from the developer fluid to a critical extent. FIG. 3 shows these relationships. Here the layer 8 of developer fluid with toner particles 9 and carrier fluid TF contains toner particles 9 of different sizes, wherein a portion of the toner particles 9 have a smaller size. The capillaries 11 in the developer fluid layer 8 therefore have smaller diameters in comparison to those in FIG. 2.

In a second embodiment, according to FIG. 1 the conditioning unit 32 is arranged adjacent to the transfer roller 30 in order to supply additive particles 12 of smaller size to the developer fluid. For this a conditioning roller 320 scoops carrier fluid with the additive particles 12 from a pan 321. The size distribution of the additive particles 12 then settles below the size distribution of the toner particles 9; and it lies between 0.1 μm and 0.5 μm, for example. The additive particles 12 should be selected so as to be transparent. It would be advantageous if the additive particles 12 were to not influence the fixing properties of the toner particles 9. However, the additive particles 12 could also be selected so that they have specific fixing properties, for example a low glass transition. Wax or paraffin can be cited as additive particles 12, for example.

The preferred embodiment of the invention has been described in connection with a transfer roller 30; however the invention is not limited to this (the transfer unit can also have a transfer belt, for example).

Although a preferred exemplary embodiment is shown and described in detail in the drawings and in the preceding specification, it should be viewed as purely exemplary and not as limiting the invention. It is noted that only a preferred exemplary embodiment is shown and described, and all variations and modifications that presently or in the future lie within the protective scope of the invention should be protected.

I claim as my invention:

1. A method to optimize transfer of a developer fluid on a printing substrate in an electrophoretic printing apparatus, comprising the steps of:

providing the developer fluid with at least carrier fluid and toner particles for application to said printing substrate, the toner particles having diameters that are greater than diameters of capillaries in a surface of the printing substrate;

providing a roller or belt for receiving the developer fluid and for transferring the developer fluid to the printing substrate; and adding additive particles to the developer fluid at the roller or belt before the transfer to the printing substrate but after the roller or belt has received the developer fluid, diameters of the additive particles being selected such that the diameters are smaller at least in part in comparison to the diameters of the capillaries in the surface of the printing substrate to reduce drawing of said carrier fluid into said substrate.

2. The method according to claim 1 wherein given a minimal diameter of the capillaries of 0.2 μm in the printing substrate, a distribution of the diameters of the additive particles extends below 0.2 μm.

3. The method according to claim 2 wherein toner particles are used as said additive particles.

4. The method according to claim 1 wherein transparent particles having a diameter distribution selected in a range from 0.1 to 0.5 μm are added as said additive particles to the developer.

5. The method according to claim 4 wherein properties of the additive particles are selected so that a fixing of the toner images is improved.

6. The method according to claim 4 wherein the roller comprises a transfer roller and a conditioning unit adjacent to the transfer roller is provided, the conditioning unit applying the additive particles to the transfer roller.

7. The method according to claim 6 wherein the additive particles are arranged together with the carrier fluid in a trough through which a conditioning roller runs in order to scoop the additive particles with carrier fluid from the trough and supply the scooped additive particles to the transfer roller.

* * * * *